US009392839B2

(12) United States Patent
Koyess et al.

(10) Patent No.: US 9,392,839 B2
(45) Date of Patent: Jul. 19, 2016

(54) LAMINATE QUARTER PANEL FOR A SKATE BOOT AND SKATE BOOT FORMED THEREWITH

(75) Inventors: Philippe Koyess, Lachine (CA); Alexandre Chretien, Laval (CA)

(73) Assignee: SPORT MASKA INC., Montreal, Quebec ( * ) Notice: Subject to any disclaimer, the term of this patent is extended or adjusted under 35 U.S.C. 154(b) by 475 days.

(21) Appl. No.: 13/345,469

(22) Filed: Jan. 6, 2012

(65) Prior Publication Data

US 2013/0174449 A1 Jul. 11, 2013

(51) Int. Cl.
*A43B 23/02* (2006.01)
*A43B 5/16* (2006.01)

(52) U.S. Cl.
CPC ..... *A43B 5/1625* (2013.01); *A43B 5/1666* (2013.01); *A43B 23/0235* (2013.01)

(58) Field of Classification Search
CPC ..... A43B 3/16; A43B 23/026; A43B 23/02; A43B 23/0235; A43B 23/0255; A43B 23/42
USPC ..... 36/107, 89, 55, 51, 48
See application file for complete search history.

(56) References Cited

U.S. PATENT DOCUMENTS

| | | | | | |
|---|---|---|---|---|---|
| 300,526 | A | * | 6/1884 | Stowe | 36/47 |
| 2,772,995 | A | * | 12/1956 | Cooper | 442/328 |
| 3,659,361 | A | * | 5/1972 | White, Sr. | 36/89 |
| 3,762,075 | A | * | 10/1973 | Munschy | 36/97 |
| 4,509,276 | A | * | 4/1985 | Bourque | 36/115 |
| 4,835,885 | A | * | 6/1989 | Hoshizaki et al. | 36/115 |
| 4,862,606 | A | * | 9/1989 | Siskind et al. | 36/77 M |
| 4,960,135 | A | * | 10/1990 | Nelson | 602/27 |
| 5,117,568 | A | * | 6/1992 | Mitsui | 36/54 |
| 5,152,082 | A | * | 10/1992 | Culpepper | 36/89 |
| 5,343,638 | A | * | 9/1994 | Legassie et al. | 36/29 |
| 5,345,638 | A | * | 9/1994 | Nishida | 12/146 C |

(Continued)

FOREIGN PATENT DOCUMENTS

| | | |
|---|---|---|
| EP | 2250914 | 11/2010 |
| GB | 496056 | 11/1938 |
| GB | 2437241 A | 10/2007 |

OTHER PUBLICATIONS

Alkali CA9 Roller Hockey Skates Sr 2011; http://www.inlinewarehouse.com/Alkali_CA9_Roller_Hockey_Skates_Sr_2011/descpage-AC9SS.html; Dec. 2, 2011; 4 pages.

(Continued)

*Primary Examiner* — Robert J Hicks
*Assistant Examiner* — Timothy K Trieu
(74) *Attorney, Agent, or Firm* — Norton Rose Fulbright Canada

(57) ABSTRACT

A laminate skate boot having a heel portion, the skate boot comprises: A thermo-shaped laminate quarter panel, the laminate quarter panel forming, at least in part, a quarter of the skate boot. A is heel pocket in the laminate quarter panel in the heel portion of the skate boot for accommodating a heel of a wearer of the boot. A rigid element is within the laminate quarter panel shaped and dimensioned to border, at least in part, the heel pocket. Also, a laminate quarter panel for use in fabricating the skate boot, the laminate quarter panel comprising a rigid element within the laminate quarter panel shaped and dimensioned to border, at least in part, a heel pocket in a heel portion of the skate boot to be fabricated, the heel pocket for accommodating a heel of a wearer of the skate boot.

24 Claims, 4 Drawing Sheets

(56) References Cited

U.S. PATENT DOCUMENTS

| | | | | |
|---|---|---|---|---|
| 5,406,721 | A | 4/1995 | Marcolin | |
| 5,498,033 | A * | 3/1996 | Hoshizaki et al. | 280/841 |
| 5,544,430 | A * | 8/1996 | Jacko | 36/7.1 R |
| 5,746,015 | A * | 5/1998 | Clement et al. | 36/93 |
| 5,761,835 | A * | 6/1998 | Okajima | 36/89 |
| 6,018,892 | A | 2/2000 | Acheson et al. | |
| 6,079,128 | A * | 6/2000 | Hoshizaki et al. | 36/89 |
| 6,102,412 | A * | 8/2000 | Staffaroni | 280/11.225 |
| 6,455,448 | B1 * | 9/2002 | Davenport et al. | 442/148 |
| 6,457,265 | B1 * | 10/2002 | Lepage et al. | 36/117.1 |
| 6,558,784 | B1 * | 5/2003 | Norton et al. | 428/304.4 |
| 6,679,695 | B2 * | 1/2004 | Kusy et al. | 425/106 |
| 6,826,853 | B1 * | 12/2004 | Zanatta | 36/131 |
| 6,871,424 | B2 * | 3/2005 | Labonte et al. | 36/115 |
| 6,935,054 | B2 * | 8/2005 | Hall et al. | 36/117.1 |
| 7,055,267 | B2 * | 6/2006 | Wilson et al. | 36/55 |
| 7,316,083 | B2 * | 1/2008 | Labonte | 36/115 |
| 7,325,336 | B2 * | 2/2008 | Yamashita et al. | 36/102 |
| 7,347,011 | B2 * | 3/2008 | Dua et al. | 36/45 |
| 7,509,756 | B2 * | 3/2009 | Lebo | 36/89 |
| 7,523,567 | B1 * | 4/2009 | McClelland | 36/115 |
| 7,549,185 | B2 | 6/2009 | Yang | |
| 7,587,841 | B2 * | 9/2009 | Culpepper | 36/89 |
| 7,676,959 | B2 * | 3/2010 | Wilder | 36/117.1 |
| 7,770,307 | B2 * | 8/2010 | Meschter | 36/45 |
| 7,875,229 | B2 * | 1/2011 | Wright et al. | 264/320 |
| 8,245,419 | B2 * | 8/2012 | Echols | 36/88 |
| 8,302,329 | B2 * | 11/2012 | Hurd et al. | 36/88 |
| 8,366,856 | B2 * | 2/2013 | Lee | 156/253 |
| 8,438,757 | B2 * | 5/2013 | Roser | 36/89 |
| 8,529,484 | B2 * | 9/2013 | Savard et al. | 602/28 |
| 8,572,866 | B2 * | 11/2013 | Dojan et al. | 36/3 A |
| 2001/0042324 | A1 * | 11/2001 | Filice | 36/115 |
| 2001/0055684 | A1 * | 12/2001 | Davis et al. | 428/379 |
| 2003/0200679 | A1 * | 10/2003 | Wilson et al. | 36/55 |
| 2004/0053035 | A1 * | 3/2004 | Haas | 428/311.51 |
| 2004/0216332 | A1 * | 11/2004 | Wilson et al. | 36/55 |
| 2005/0028405 | A1 * | 2/2005 | Wilson et al. | 36/55 |
| 2005/0193594 | A1 * | 9/2005 | Murphy | 36/89 |
| 2005/0210709 | A1 * | 9/2005 | Labonte | 36/89 |
| 2006/0051566 | A1 * | 3/2006 | Challe | 428/304.4 |
| 2006/0137226 | A1 * | 6/2006 | Jung et al. | 36/89 |
| 2006/0179686 | A1 * | 8/2006 | Labonte | 36/89 |
| 2007/0180730 | A1 * | 8/2007 | Greene et al. | 36/3 A |
| 2007/0199210 | A1 * | 8/2007 | Vattes et al. | 36/45 |
| 2008/0252061 | A1 | 10/2008 | Demmers et al. | |
| 2009/0188056 | A1 * | 7/2009 | Labonte | 12/142 P |
| 2010/0011619 | A1 * | 1/2010 | Bastianelli et al. | 36/87 |
| 2010/0107452 | A1 * | 5/2010 | Baychar | 36/3 R |
| 2010/0319217 | A1 * | 12/2010 | Echols | 36/89 |
| 2011/0173841 | A1 * | 7/2011 | McDuff | 36/89 |
| 2012/0015155 | A1 * | 1/2012 | Blackford et al. | 428/189 |
| 2012/0189852 | A1 * | 7/2012 | Lee et al. | 428/411.1 |
| 2012/0227282 | A1 * | 9/2012 | Hawkinson et al. | 36/87 |

OTHER PUBLICATIONS

Reebok Player 2010 Hockey Catalog.
Design U.S. Appl. No. 29/359,987, filed Apr. 19, 2010.

* cited by examiner

LAMINATE QUARTER PANEL FOR A SKATE BOOT AND SKATE BOOT FORMED THEREWITH

FIELD OF THE INVENTION

The present invention relates to a laminate quarter panels for skate boots and to skates formed with such laminate quarter panels.

BACKGROUND

Skates are a type of footwear commonly used in many athletic activities such as ice skating, ice hockey, inline roller skating, inline roller hockey, etc. A skate typically has a skate boot and a ground-engaging skate element such as a blade or a set of inline rollers attached to the underside of the boot permitting movement of the skate (and its wearer) across an appropriate surface. The skate boot typically covers all of the foot and part of the leg of a wearer.

Skates have been around for some time and are well known in the art. While in some ways similar to other footwear, they have their own unique design characteristics owing to the use to which they are put. Skating is not the same as walking, hiking, skiing, etc. Thus, for example, skates should be comfortable to wear while skating (especially during hockey play in the case of hockey skates), provide good control while skating (especially during hockey play in the case of hockey skates), and have a relatively long lifetime (as compared with some other types of footwear). The comfort and control provided by a skate depend on many factors including the hardness of the skate boot, the flexibility in the ankle in the area of the skate boot, the overall flexibility of the skate, the conformity of the skate boot to the foot of a wearer, and the weight of the skate. A skate boot's resistance to cuts, ruptures and impacts is also important because it contributes to the safety of the user and the useful lifetime of the skate. A skate's useful lifetime also depends on resistance to cyclic stresses and forces applied to the skate while skating.

Conventionally there are two different kinds of skates, which are separated according to the manner in which their skate boots are constructed. The more traditional of these is the "lasted" skate boot, while the other is the "non-lasted" skate boot (sometimes referred to as "molded" skate boots—although lasted skate boots may have components that were molded—and although there are other non-lasted methods of manufacturing besides molding).

The "lasted" skate boot is made in a manner similar to traditional shoe making techniques. As the name would suggest, a last (i.e., a traditionally wooden model of a foot used for making shoes or boots) or other similar form is used in the manufacture of this type of boot. The process of making a lasted boot starts with preparing the various materials from which the boot is to be made. This traditionally involves cutting out various shapes and forms from various layers of material (which might be leathers, synthetic fabrics, natural fabrics, foams, plastics, etc.) necessary to form the completed boot. These various shapes and forms are then superimposed on the last, worked to form the appropriate foot shape and secured together via any appropriate method (e.g. stitching, gluing, tacking, etc.).

While this traditional method has been employed for some time, and is still in wide use today, lasted skate boots have their disadvantages, most of which are well known in the art. Among them are the following: Given the number of actions and manipulations that are required, the manufacture of a lasted skate boot tends to be very labour intensive, and therefore more costly than non-lasted manufacturing techniques, meaning that lasted boots can be expensive to manufacture. Further, lasted skate boots tend to conform less well to the foot of a wearer given that a last merely approximates the three dimensional shape of a human foot, and that, in any event, the boots tend not to be of the exact shape of the last. Also, as the skate boot is made generally from layers of flat materials that are bent on the last to form the three-dimensional shape of the boot, after bending, these materials can in some instances contain stresses within them that may lead to the skate boot being more easily damaged. Further, lasted skate boots have a relatively long "break in time", i.e., a period of time for which a wearer must wear the skates to break them in to get the skate boots to more comfortably conform to and fit the wearer's foot. Finally, lasted skate boots produced in this manner are not identical to one another (despite the use of the same last) since they are each individually made. Their quality depends (at least in part) on the skill and craftsmanship of the person who put them together.

For these reasons, skate manufacturers have made attempts over the years at improving lasted skate boots. For instance, some have attempted to simplify the manufacturing process by reducing the number of layers of materials of which the boot is made, by adding in various molded plastic shells (usually in place of other materials), by making a "sandwich" of the layers of material of which the boot is to be made before putting the materials on the last and then bending the entire sandwich around the last.

One such type of "sandwich" design is a laminate quarter panel. As the name suggests, a laminate quarter panel is a multi-layer structure (typically, but not always made of a variety of thermo-shapable polymers) that when heated, folded around a last and shaped, will form all or almost all of the quarter panel of a skate boot. (One example of such a laminate quarter panel is provided in U.S. Pat. No. 7,879,423, which is incorporated by reference herein in its entirety.)

Lasted skate boots made of laminated quarter panels comprising polymeric materials may be made more comfortable (at least to some wearers) by providing therein a heel shape. Such a heel shape in the heel portion of the skate boot generally accommodates the heel of a wearer. Conventionally, heel shapes have been made in lasted boots by providing the last with an appropriate form to impart a heel shape during the thermo-shaping of the laminated quarter panel during formation of the skate boot. Heel shapes formed in this manner are acceptable to some skate boot wearers, but others have found this design to be less than optimal. Improvements in this area are possible.

SUMMARY

It is an object of the present invention to ameliorate at least some of the inconveniences present in the prior art.

It is another object of the present invention to provide a skate boot with improved heel accommodation at least with respect to some of the prior art.

Thus, in one aspect, as is broadly described herein, some embodiments of the present invention provide a laminate skate boot having a heel portion. The skate boot comprises a thermo-shaped laminate quarter panel. The laminate quarter panel forms, at least in part, a quarter of the skate boot. The skate boot further comprises a concave heel section defining a heel pocket in the laminate quarter panel in the heel portion of the skate boot for accommodating a heel of a wearer of the boot. The skate boot further comprises a rigid element within the laminate quarter panel shaped and dimensioned to border, at least in part, the part of the concave heel section defining the heel pocket 158. In some embodiments the rigid element is also thermo-shaped.

It has been realized that by providing a rigid element within the quarter panel that is sized and dimensioned to border the heel pocket (at least in part) provides (at least for some wearers of appropriately sized skate boots) increased "heel lock". "Heel lock" is the ability of skate boot to retain the heel of the wearer of the skate within the heel pocket and/or to prevent the wearer's heel from slipping within the skate during skating (during which time the skate/foot is subjected to higher and/or different stresses than when a person is standing or walking, etc.) In the present context a "rigid element" is an element that causes the skate boot in the area in which the rigid element is located to have (at least) locally increased rigidity (e.g., less flexibility) as compared with the area of the heel pocket of the skate boot adjacent the rigid element in which there is no rigid element. In most embodiments, a rigid element is not, however, completely inflexible during use of the skate, some flexibility (albeit less than the adjacent area) is present. In some embodiments, the rigid element is not, by itself, inflexible. For example, in some embodiments, the rigid element is a flexible composite comprising a flexible fiber layer sandwiched between two flexible polymer layers. In other embodiments, the rigid element is, by itself, mostly inflexible. For example, in some embodiments, the rigid element is a rigid composite such as fiber contained in a rigid polymer matrix.

In the context of the present specification, "thermo-shaped" should be understood as meaning an element, structure, material, etc. that has been given a form through a process that includes (but is not necessarily limited to) the application of heat, i.e., the application of heat is material to the process. (Similarly, in the context of the present specification, an element, structure, material, etc. that is "thermo-shapable" should be understood to mean one that may be given a form through a process that includes (but is not necessarily limited to) the application of heat.)

Without wishing to be bound by any particular theory, it is theorized that what occurs during the thermo-shaping of the laminate quarter panel during its processing to form the skate boot is that the area of the quarter panel that will form the heel pocket which does not include the rigid element will be more flexible during the process than will be the area forming the border of the heel pocket that does include the rigid element. Thus the area forming the heel pocket will "stretch out" further during heat working of the quarter panel than will the area having the rigid element. This seems to cause the formation of a structure which provides better heel lock in the final skate boot (at least for some wearers as compared to some of the prior art).

In the context of the present specification, the rigid element "bordering" the heel pocket is not intended to be restricted to structures wherein there is an absolute absence of rigid element in the heel pocket. A rigid element may immaterially extend into the heel pocket within context of the present specification.

Further, in the present context, a rigid element is not intended to be restricted to a single structure (although single structures are included). Multiple structures having similar synergistic functions are included within a "rigid element".

In some embodiments the rigid element includes a fiber-reinforced polymeric element. Examples of such materials in an element include a layer of carbon fiber, glass fiber, para-aramid synthetic fiber, polypropylene fiber, boron fiber, or a combination thereof in matrix (which may, for example, be thermoplastic or thermosetting resin). Such layers of fiber material can include woven or nonwoven layers of fibers or combinations thereof. The fibers can be in the form of continuous fibers or discontinuous fibers and can be aligned, patterned, or randomly oriented. In some of such embodiments the fiber-reinforced polymeric element is a laminate element that includes a non-fiber reinforced polymeric layer, which may be any suitable material, such as a thermoplastic material such as, for example, a thermoplastic ionomer resin (e.g., Surlyn™ resin; Surlyn is a trademark of E. I. du Pont de Nemours and Company) or thermoplastic polyurethane (TPU). In some of such embodiments the fiber-reinforced polymer element is a laminate element that includes a fiber layer sandwiched between two non-fiber reinforced polymeric layers (i.e., two polymer layers that contain no fiber reinforcement). Thus non-limiting examples of various embodiments of rigid elements include: (1) a woven or nonwoven fabric enveloped in layers of non-fiber reinforced polymeric layers (e.g., glass fiber fabric sandwiched between Suryln™ layers); (2) a woven or nonwoven fabric enveloped in layers of fiber reinforced polymeric layers (e.g., glass fiber fabric sandwiched between Suryln™ layers which also contain fiber); (3) fiber in a polymeric matrix (e.g., glass fiber impregnated with a Suryln™ resin matrix); and (4) fibers in a polymeric matrix and enveloped in layers of fiber reinforced or non-fiber reinforced polymeric layers (e.g., glass fiber impregnated with a Suryln™ resin matrix and sandwiched between Suryln™ layers).

The rigid element is not limited solely to fiber-reinforced polymer structures. In some embodiments the rigid element is a thermoplastic or a thermoset polymer structure such as, for example, a thermoplastic or thermoset plate, mesh, or honeycomb structure. In some embodiments the rigid element includes a metal plate, a metal bar, a wire, a metal mesh, and combinations thereof. In some embodiments, the rigid element is one of the foregoing (e.g., a metal plate, a plastic plate, a metal mesh, or a plastic mesh) enveloped by polymeric layers (e.g., Surlyn™ layers)).

In some embodiments, the rigid element is positioned to be on the heel portion of the skate boot. For example, in some embodiments, the rigid element is positioned to extend up from a point at the top of or just above the calcaneus region of a wearer's foot (e.g., near the portion of the foot where the Achilles tendon meets the calcaneus). In certain instances, the rigid element extends up from a point at the top of or just above the calcaneus region of a wearer's foot for at least about 2 cm in the direction that the Achilles tendon extends. For example, in some embodiments, the rigid element extends up from a point at the top of or just above the calcaneus region of a wearer's foot for at least about 3 cm in the direction that the Achilles tendon extends.

In some embodiments, the rigid element is positioned on the heel portion of the skate boot and extends downwardly and forwardly from the heel portion on a lateral side of the skate boot and extends downwardly and forwardly from the heel portion on a medial side of the skate boot. In some of such embodiments, the rigid element extends downwardly and forwardly on a lateral side and on a medial side to a position proximate to the sole of the skate boot. In certain instances, portions of the rigid element extending downwardly and forwardly on a lateral side and/or on a medial side (as the case may be) have a width of at least about 1 cm. In other instances, the portions of the rigid element extending downwardly and forwardly on a lateral side and/or on a medial side have a width of at least about 2 cm such as, for example, about 2.5 cm. In some embodiments, the portions of the rigid element extending downwardly and forwardly on a lateral side and/or on a medial side have a length (measured from the middle of the rigid element of the skate to a lateral or medial distal end) of about 4 to about 12 cm such as, for example, about 6 to about 10 cm or about 8 to about 10 cm.

In other embodiments, the rigid element is positioned solely on the heel portion, solely on the medial side, or solely on the lateral side of the skate boot. In still other embodiments, the rigid element is positioned on any two of the heel portion, the medal side, and the lateral side of the skate boot.

Without wishing to be bound by any particular theory, it is theorized that the greater the extent to which the heel pocket is bordered by the rigid element, the greater the heel lock will be (at least in some embodiments and for some users).

In some embodiments the laminate skate boot further comprises a thermo-shaped polymeric foam layer towards the interior of the skate boot (e.g., expanded polyethylene or expanded polypropylene), and a first thermo-shaped polymeric material layer exteriorly of the polymeric foam layer (e.g., Surlyn™ resin or TPU); and wherein the fiber-reinforced element is affixed to at least one of the polymeric foam layer and the first polymeric material layer. Such affixation may occur in any suitable manner and/or configuration. As a non-limiting example a peripheral edge of the rigid element (or portions thereof where the rigid element is a laminate element) may be affixed to an underlapping and/or overlapping portion of one of the layers.

In some embodiments the laminate skate boot further comprises a thermo-shaped polymeric foam layer towards the interior of the skate boot, a reinforcement layer (e.g., a composite nonwoven polyester sheet such as KP™ sheeting available from Kang-Pao Industrial Co. in China, or Formo™ sheeting (a trademark of Texon International) exteriorly of the polymeric foam layer, a first thermo-shaped polymeric material layer exteriorly of the reinforcement layer, a second thermo-shaped polymeric material layer exteriorly of the first polymeric material layer, and the fiber-reinforced element is affixed to at least one of the first polymeric material layer and the second polymeric material layer.

In another aspect, as is broadly described herein, some embodiments of the present invention provide a laminate quarter panel for use in fabricating a skate boot (e.g., the skate boot described above). The laminate quarter panel comprises a rigid element within the laminate quarter panel shaped and dimensioned to border, at least in part, a heel pocket in a heel portion of the skate boot to be fabricated, the heel pocket for accommodating a heel of a wearer of the skate boot.

In some embodiments, the rigid element includes a fiber-reinforced polymeric element. In some of such embodiments, the fiber-reinforced polymeric element is a laminate element that further includes a non-fiber reinforced polymeric layer. In some of such embodiments the fiber-reinforced polymer element is a laminate element that includes a fiber layer sandwiched between two non-fiber reinforced polymeric layers.

In some embodiments, the fiber-reinforced polymeric element also extends downwardly and forwardly on a lateral side of the skate boot and extends downwardly and forwardly on a medial side of the skate boot to be fabricated. (In other embodiments, the rigid element is positioned solely on the heel portion, solely on the medial side, or solely on the lateral side of the skate boot to be fabricated. In still other embodiments, the rigid element is positioned on any two of the heel portion, the medal side, and the lateral side of the skate boot to be fabricated.)

In some embodiments, the fiber-reinforced polymeric element is thermo-shapable.

In some embodiments the laminate quarter panel for use in fabricating a skate boot further comprises a thermo-shapable polymeric foam layer to be oriented towards the interior of the skate boot to be fabricated, and a first thermo-shaped polymeric material layer to be oriented exteriorly of the polymeric foam layer in the skate boot to be fabricated; and the fiber-reinforced element is affixed to at least one of the polymeric foam layer and the first polymeric material layer.

In some embodiments the laminate quarter panel for use in fabricating a skate boot further comprises a thermo-shapable polymeric foam layer to be oriented towards the interior of the skate boot to be fabricated, a reinforcement layer to be oriented exteriorly of the polymeric foam layer in the skate boot to be fabricated, a first thermo-shapable polymeric material layer to be oriented exteriorly of the reinforcement layer in the skate boot to be fabricated, a second thermo-shapable polymeric material layer to be oriented exteriorly of the first polymeric material layer in the skate boot to be fabricated; and the fiber-reinforced element is affixed to at least one of the first polymeric material layer and the second polymeric material layer.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
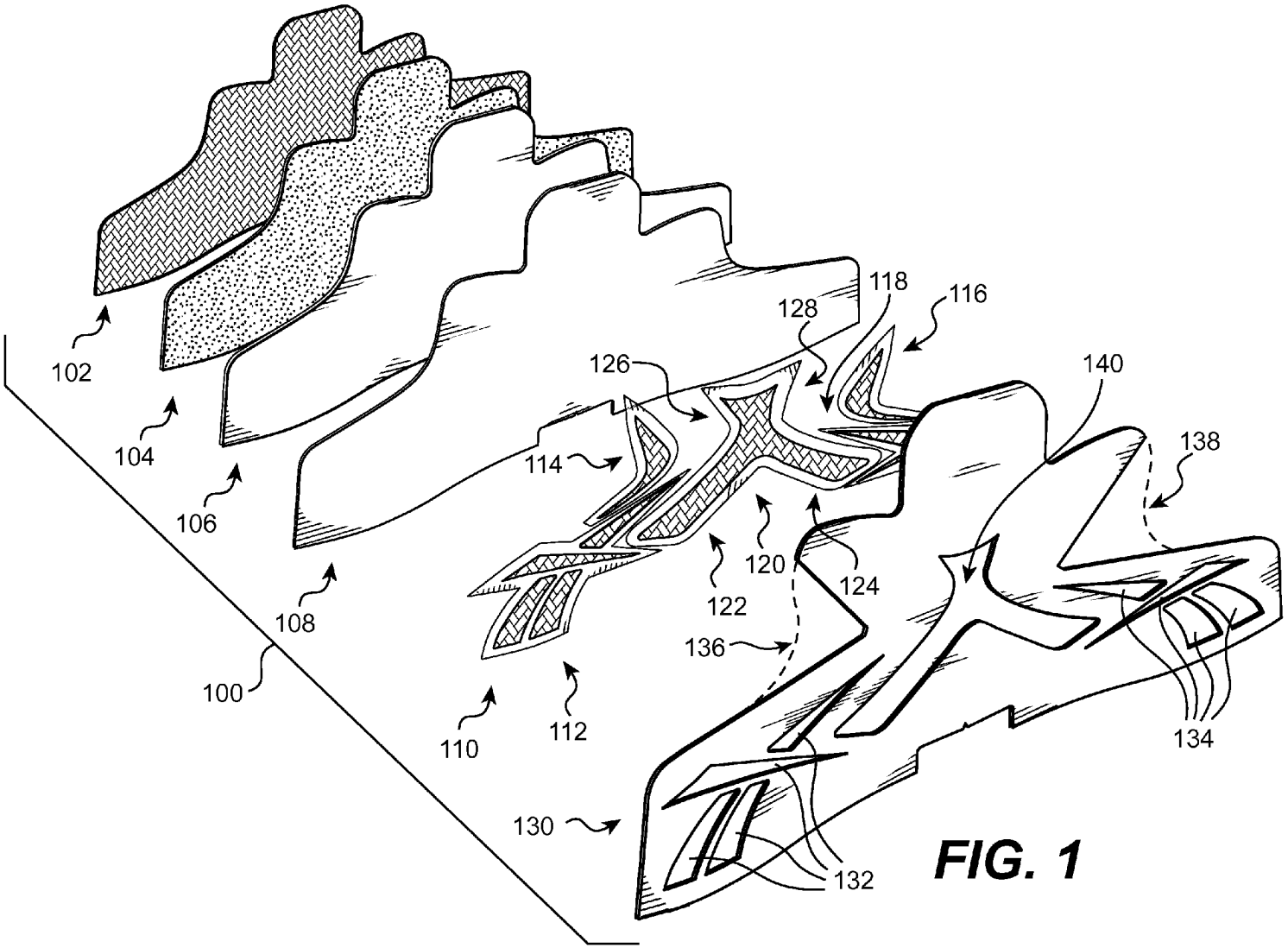
FIG. 1 is an exploded view of a laminate quarter panel for a skate boot being an embodiment of the present invention.
Figure 2:
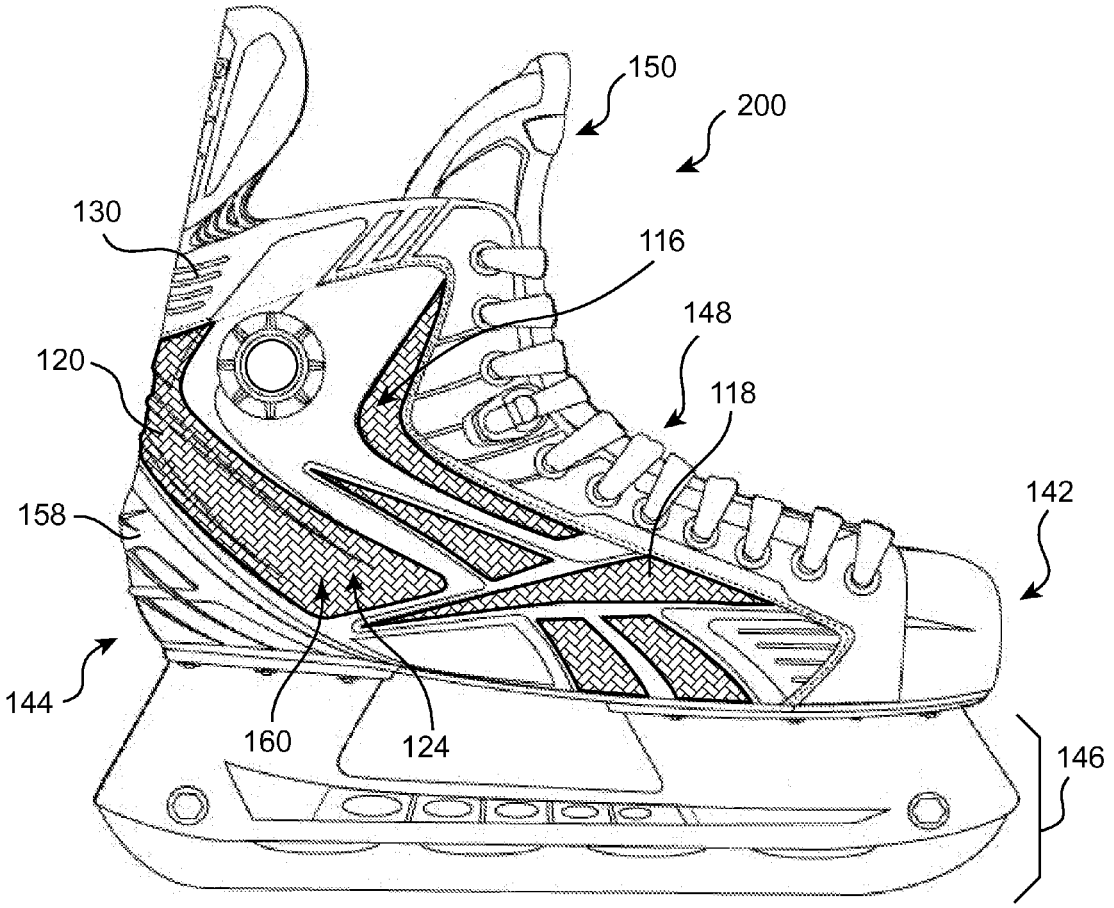
FIG. 2 is a right side elevation view of a skate boot having been formed using the laminate quarter panel of FIG. 1.

Referring to FIG. 1, there is shown (when assembled) a laminate quarter panel 100 for use in fabricating a skate boot 200 (FIG. 2). As can be seen in the Figure, the laminate quarter panel 100 is generally appropriately sized and shaped to form the quarter panel 160 of the skate boot 200.

In this embodiment, the laminate quarter panel 100 includes several layers of thermo-shapable polymers. A first layer 102, the interior-most (with respect to the skate boot 200) layer of the quarter panel 100, is a thin layer of polyester mesh (polyester being a thermoplastic polymer). The first layer 102 extends throughout the quarter panel 100 and has the same general exterior shape as the quarter panel 100 itself.

A second layer 104, disposed exteriorly of the first layer 102 (when the quarter panel 100 is appropriately oriented for its use in formation of the skate boot 200), is an about 4 to about 10 mm thick layer of expanded polypropylene (EPP) foam. The EPP foam of the second layer 104 is thermo-shapable. The second layer 104 extends throughout the quarter panel 100 and has the same general exterior shape as the quarter panel 100 itself. The purpose of the second layer 104 is to form a structural core for the skate boot 200.

A third layer 106, disposed exteriorly of the second layer 104, is an about 1 mm to about 5 mm thick layer of non-woven fabric reinforcement such as Formo™ or KP™ sheeting. The third layer 106 extends throughout the quarter panel 100 and has the same general exterior shape as the quarter panel 100 itself. The purpose of the third layer 106 is to form a reinforcement layer for reinforcing the structural core provided by the foam layer 104.

A fourth layer 108, disposed exteriorly of the third layer 106, is an about 0.01 to about 0.2 inch thick layer of Surlyn™ (a thermo-shapable polymer) with a laminated nylon mesh. The fourth layer 108 extends throughout the quarter panel 100 and has the same general exterior shape as the quarter panel 100 itself. The purpose of the fourth layer 108 is to provide additional structure and protection to the skate boot 200.

A fifth layer 130, disposed exteriorly of the fourth layer 108, is an about 0.010 to about 0.2 inch thick layer of Surlyn™ polymer (a thermo-shapable polymer). As is shown in FIG. 1, the fifth layer 130 extends generally throughout the quarter panel 100 and has generally the same exterior shape as the quarter panel 100 itself, however certain portions and sections present in the other layers 102, 104, 106, 108 are not present in the fifth layer 130. In this respect the fifth layer 130 has several areas where there is no material (as compared with the other layers 102, 104, 106, 106); the fifth layer has "holes" 132, 134 and 140, as well as missing areas 136 and 138 (as compared with the other layers). The purpose of the fifth layer 130 is to provide additional structure and protection, and ornamentation to the skate boot 200.

Figure 4:
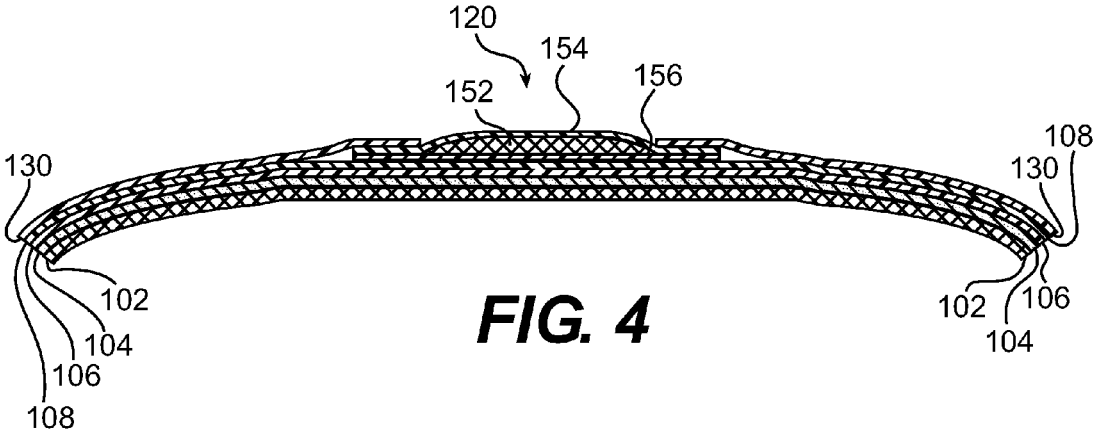
FIG. 4 is a cross-section of the skate boot of FIG. 2 taken along the line 4-4 in FIG. 3.

Intermediate the fourth layer 108 and the fifth layer 130 (and affixed to both of them) is a rigid element 120. As can best be seen in FIGS. 4 and 5, rigid element 120 is a laminate element having a (thermo-shapable) glass fiber central layer 152, which is about 0.2 to about 0.3 mm thick. Laminated on both sides of the glass fiber central layer 152, is a layer of (thermo-shapable) Surlyn™ polymer 154, 156. Each of the Surlyn™ polymer layers 154, 156 are about 0.05 to about 0.1 mm thick, and thus the total thickness of rigid element 120 is about 0.3 to about 0.5 mm. Layers of Surlyn™ polymer 154, 156 meet and are joined at the periphery of rigid element 120 forming a peripheral border of Surlyn™ polymer. The rigid element 120 is positioned with respect to the fourth layer 108 and the fifth layer 130 so as to generally occupy the central "hole" 140 in the fifth layer. A portion of the fifth layer 130 (e.g. the portion nearest to and defining central hole 140) overlaps a portion of the periphery of the rigid element 120, and is affixed thereto. (In other embodiments other configurations are possible. For example the portion of the fifth layer could be affixed to the portion of the rigid element where the two Surlyn™ layers meet and/or to at least a portion of a Surlyn™ layer lying over the glass fiber central layer.)

The rigid element 120 when flat within the quarter panel 100, is generally an inverted Y-shape, having two downwardly extending arms 122 and 124 and two very small upwardly extending portions 126, 128. The rigid element 120 being shaped, dimensioned and positioned as it is within the laminate quarter panel 100, the rigid element 120 will extend across the heel portion 144 of the skate boot 200 (above the concave heel section or heel pocket 158) and each of the arms 122, 124 will extend downwardly and forwardly on the medial or lateral side of the skate boot 200 (as the case may be). All will border the heel pocket 158.

Also present within the skate boot are additional elements 112, 114, 116, and 118. Similar to rigid element 120, additional elements 112, 114, 116 and 118 are each laminate elements having a glass fiber central layer, which is about 0.2 to about 0.3 mm thick. Laminated on both sides of the glass fiber central layer, is a layer of (thermo-shapable) Surlyn™ polymer. Each of the Surlyn™ polymer layers 154, 156 are about 0.05 to about 0.1 mm thick, and thus the total thickness of each of the additional elements 112, 114, 116 and 118 is about 0.3 to about 0.5 mm. Additional elements 112 and 118 are positioned intermediate the fourth layer 108 and the fifth layer 130 (and affixed to both of them) so as to generally occupy the "holes" 132, 134 (respectively) in the fifth layer. A portion of the fifth layer 130 (e.g., the portion nearest to and defining holes 132, 134) overlaps a portion of the periphery of the additional elements 112 and 118. Additional elements 114 and 116 are positioned intermediate the fourth layer 108 and the fifth layer 130 (and affixed to both of them) so as to generally occupy the missing material areas 136, 138 (respectively) in the fifth layer. Together with the rigid element 120, additional elements 112, 114, 116 and 118 may notionally be layer 110 intermediate the fourth layer 108 and the fifth layer 130.

Figure 3:
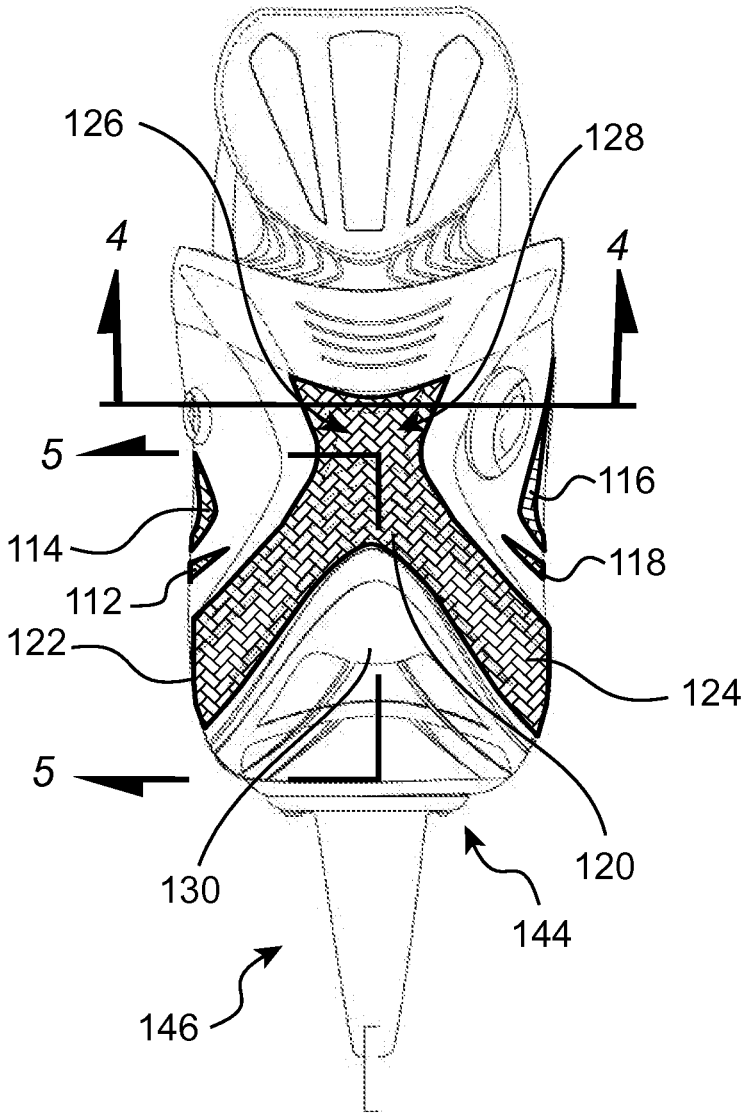
FIG. 3 is a rear elevation view of the skate boot of FIG. 2.
Figure 5:
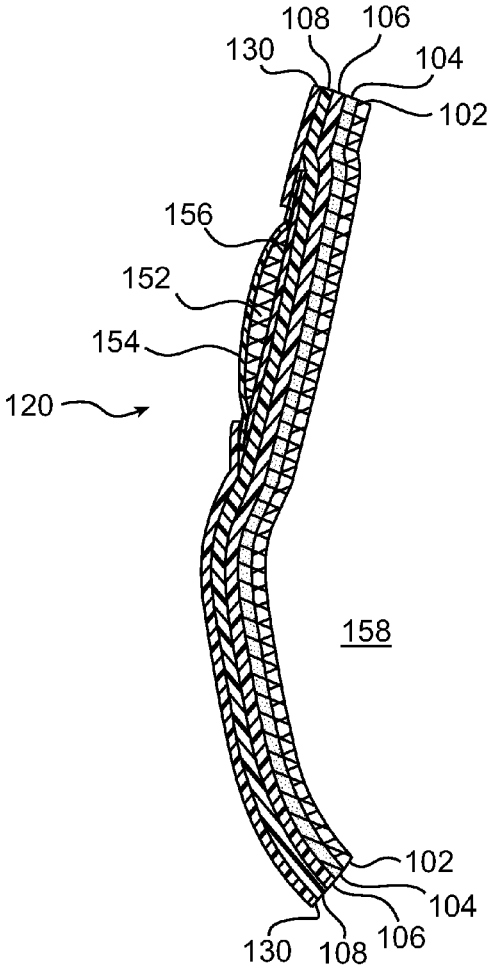
FIG. 5 is a cross-section of the skate boot of FIG. 2 taken along the line 5-5 in FIG. 3

Referring to FIGS. 2 and 5, the skate boot 200 has a toe portion 142 and a heel portion 144. Present in the heel portion 144 is a heel pocket 158. The heel pocket 158 is sized and dimensioned to accommodate the heel bone (not shown) of an appropriately sized user of the skate. The rigid element 120 is sized, dimensioned and shaped so as to border at least the upper portion of the heel pocket 158. As can be seen in FIG. 5, for example, the center of rigid element 120 is positioned so as to be at or above the heel pocket 158. In some embodiments, such as that as shown in FIGS. 2 and 3, at least a portion of downwardly extending arms 122 and 124 of rigid element 120 are sized, dimensioned, and shaped so as to border a portion of the heel pocket 158. As can be seen from FIGS. 2-3 and 5, the rigid element 120 borders part of the concave heel section without extending in the heel pocket 158.

As part of the fabrication process of the skate boot 200, each of the individual layers 102, 104, 106, 108, 110 (rigid element 120 and additional elements 112, 114, 116, 118), 130 are individually fabricated in a method appropriate to their materials of construction. The individual layers 102, 104, 106, 108, 110, 130 are then brought together and aligned one with respect to another as is appropriate (as was described herein above). The individual layers 102, 104, 106, 108, 110, 130 are then joined together in an appropriate manner (depending on their materials of construction) to form a single laminate quarter panel 100. At the appropriate point in the skate boot fabrication process, the laminate quarter panel 100 is placed around a last, heated, and force is applied in order to shape the laminate quarter panel into an appropriate shape. During this thermo-shaping process, the heel pocket 158 is formed as the materials thereof (layers 102, 104, 106, 108, 130—FIG. 5) stretch out more around the last than the materials forming the border of the heel pocket (layers 102, 104, 106, 108, 110 (rigid element 120), 130—FIG. 5), owing to the presence of the rigid element 120 in the latter.

When finally fabricated, also part of the skate boot 200 are conventional laces/eyelets 148 and a skate boot tongue 150. Attached to the underside of the skate boot 200 is a conventional skate blade holder/skate blade 146.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A laminate skate boot having a heel portion, the skate boot comprising:

a thermo-shaped laminate quarter panel, the laminate quarter panel forming, at least in part, a quarter of the skate boot;

the laminate quarter panel having a concave heel section in the heel portion of the skate boot, the concave heel section defining a heel pocket configured for accommodating a heel of a wearer of the boot; and a rigid element within the laminate quarter panel, the rigid element bordering at least part of the concave heel section without extending in the heel pocket, an area of the laminate quarter panel including the rigid element having a greater rigidity than an area of the concave heel section defining the heel pocket.

2. The laminate skate boot as recited in claim 1, wherein the rigid element includes a fiber-reinforced polymeric element.

3. The laminate skate boot as recited in claim 2, wherein the fiber-reinforced polymeric element is a laminate element that includes a non-fiber reinforced polymeric layer.

4. The laminate skate boot as recited in claim 3, wherein the fiber-reinforced polymeric element is positioned on the heel portion of the skate boot and extends downwardly and forwardly from the heel portion on a lateral side of the skate boot and extends downwardly and forwardly from the heel portion on a medial side of the skate boot.

5. The laminate skate boot as recited in claim 4, wherein the fiber-reinforced polymeric element is thermo-shaped.

6. The laminate skate boot as recited in claim 3, further comprising a thermo-shaped polymeric foam layer towards the interior of the skate boot, and a first thermo-shaped polymeric material layer exteriorly of the polymeric foam layer; and wherein the fiber-reinforced element is affixed to at least one of the polymeric foam layer and the first polymeric material layer.

7. The laminate skate boot as recited in claim 3, further comprising a thermo-shaped polymeric foam layer towards the interior of the skate boot, a reinforcement layer exteriorly of the polymeric foam layer, a first thermo-shaped polymeric material layer exteriorly of the reinforcement layer, and a second thermo-shaped polymeric material layer exteriorly of the first polymeric material layer; and wherein the fiber-reinforced element is affixed to at least one of the first polymeric material layer and the second polymeric material layer.

8. The laminate skate boot as recited in claim 2, wherein the fiber-reinforced polymer element is a laminate element that includes a fiber layer sandwiched between two non-fiber reinforced polymeric layers.

9. The laminate skate boot as recited in claim 1, wherein the rigid element is positioned on the heel portion of the skate boot and extends downwardly and forwardly from the heel portion on a lateral side of the skate boot and extends downwardly and forwardly from the heel portion on a medial side of the skate boot.

10. The laminate skate boot as recited in claim 1, wherein the fiber-reinforced polymeric element is thermo-shaped.

11. The laminate skate boot as recited in claim 1, further comprising a thermo-shaped polymeric foam layer towards the interior of the skate boot, and a first thermo-shaped polymeric material layer exteriorly of the polymeric foam layer; and wherein the rigid element is affixed to at least one of the polymeric foam layer and the first polymeric material layer.

12. The laminate skate boot as recited in claim 1, further comprising a thermo-shaped polymeric foam layer towards the interior of the skate boot, a reinforcement layer exteriorly of the polymeric foam layer, a first thermo-shaped polymeric material layer exteriorly of the reinforcement layer, and a second thermo-shaped polymeric material layer exteriorly of the first polymeric material layer; and wherein the rigid element is affixed to at least one of the first polymeric material layer and the second polymeric material layer.

13. A laminate quarter panel for use in fabricating a skate boot, the laminate quarter panel comprising:

a rigid element within the laminate quarter panel, the laminate quarter panel including a heel section defining a heel pocket configured for accommodating a heel of a wearer, the rigid element bordering at least part of the heel section without extending the heel pocket, an area of the laminate quarter panel including the rigid element having a greater rigidity than an area of the heel section of the laminate quarter panel defining the heel pocket.

14. The laminate quarter panel as recited in claim 13, wherein the rigid element includes a fiber-reinforced polymeric element.

15. The laminate quarter panel as recited in claim 14, wherein the fiber-reinforced polymeric element is a laminate element that includes a non-fiber reinforced polymeric layer.

16. The laminate quarter panel as recited in claim 15, wherein the fiber-reinforced polymeric element is bordering an upper portion of the heel section and extends downwardly and away from the upper portion of the heel section on one side of the heel section and extends downwardly and away from the upper portion of the heel section on the other side of the heel section.

17. The laminate quarter panel as recited in claim 16, wherein the fiber-reinforced polymeric element is thermo-shapable.

18. The laminate quarter panel as recited in claim 15, further comprising a thermo-shapable polymeric foam layer and a first thermo-shaped polymeric material layer; and wherein the fiber-reinforced element is affixed to at least one of the polymeric foam layer and the first polymeric material layer.

19. The laminate quarter panel as recited in claim 15, further comprising a thermo-shapable polymeric foam layer, a reinforcement layer adjacent the polymeric foam layer, a first thermo-shapable polymeric material layer adjacent a side of the reinforcement layer opposite the thermo-shapable polymeric foam layer, and a second thermo-shapable polymeric material layer adjacent a side of the first polymeric material layer opposite the reinforcement layer;

wherein the fiber-reinforced element is affixed to at least one of the first polymeric material layer and the second polymeric material layer.

20. The laminate quarter panel as recited in claim 14, wherein the fiber-reinforced polymer element is a laminate element that includes a fiber layer sandwiched between two non-fiber reinforced polymeric layers.

21. The laminate quarter panel as recited in claim 13, wherein the rigid element is bordering an upper portion of the heel section and extends downwardly and away from the upper portion of the heel section on one side of the heel section and extends downwardly and away from the upper portion of the heel section on the other side of the heel section.

22. The laminate quarter panel as recited in claim 13, wherein the rigid element is thermo-shapable.

23. The laminate quarter panel as recited in claim 13, further comprising a thermo-shapable polymeric foam layer and a first thermo-shaped polymeric material layer; and wherein the rigid element is affixed to at least one of the polymeric foam layer and the first polymeric material layer.

24. The laminate quarter panel as recited in claim 13, further comprising a thermo-shapable polymeric foam layer, a reinforcement layer adjacent the polymeric foam layer, a first thermo-shapable polymeric material layer adjacent a side of the reinforcement layer opposite the thermo-shapable polymeric foam layer, and a second thermo-shapable polymeric material layer adjacent a side of the first polymeric material layer opposite the reinforcement layer;

wherein the rigid element is affixed to at least one of the first polymeric material layer and the second polymeric material layer.

* * * * *